United States Patent [19]

Eisenberg

[11] 4,135,353

[45] Jan. 23, 1979

[54] ENTANGLEMENT OF A FIRST STRAND WITH A SECOND STRAND

[75] Inventor: Arnold J. Eisenberg, Granville, Ohio

[73] Assignee: Owens-Corning Fiberglas Corporation, Toledo, Ohio

[21] Appl. No.: 833,771

[22] Filed: Sep. 16, 1977

[51] Int. Cl.[2] ..... D01H 15/00

[52] U.S. Cl. ..... 57/22; 28/209; 57/6; 57/352

[58] Field of Search ..... 57/3, 22, 34 R, 34 B, 57/90, 159, 160; 28/141, 209–210; 226/91–92, 97

[56] References Cited

U.S. PATENT DOCUMENTS

| | | | |
|---|---|---|---|
| 3,217,482 | 11/1965 | Baer | 57/34 B X |
| 3,334,477 | 8/1967 | Morin et al. | 57/34 R X |
| 3,969,885 | 7/1976 | Anahara et al. | 57/34 R X |

*Primary Examiner*—Charles Gorenstein

*Attorney, Agent, or Firm*—Ronald C. Hudgens; Philip R. Cloutier; Ted C. Gillespie

[57] ABSTRACT

A method and apparatus for the entanglement of a first strand and a moving second strand are disclosed. A member having a passageway therethrough for the passage of the second strand is adapted for the circumferential positioning of the first strand. Means are provided for repositioning the first strand from the member into circumferential entanglement with the second strand by reducing the circumference of the member.

9 Claims, 3 Drawing Figures

ENTANGLEMENT OF A FIRST STRAND WITH A SECOND STRAND

This invention relates to the entanglement of a first textile strand and a moving second textile strand.

In one of its more specific aspects, this invention relates to the entanglement of a first strand of glass fibers and a moving second strand of glass fibers.

It is a common practice in the textile industry when the entanglement of a first strand with a moving second strand is desired, to have a manual entanglement or tying of the first strand to the moving second strand. For example, in a roving process an operator commonly ties an auxiliary strand onto a feeder strand or onto a roving bundle when it is desired to add an auxiliary strand to the roving bundle. As more and more textile processes become automated, and as the speed of travel of strands in textile processes is increased, there is greater need for methods and apparatus to automatically add or entangle a first strand with a moving second strand. The effective entanglement of a first strand with a moving second strand requires apparatus which is capable of accomplishing the entanglement of the strand in a short period of time. The entanglement of the strands must also be accomplished with a high degree of reliability in order to maintain high output levels in the textile process.

There has now been developed for the entanglement of a first strand and a moving second strand a method and apparatus which operates automatically, and at high speeds, to produce an entanglement of the two strands. This apparatus and method are particularly suitable for high speed textile operations such as roving operations.

According to this invention, there is provided apparatus for the entanglement of a first strand and a moving second strand comprising a member having a passageway for the passage of the second strand therethrough. The member is adapted for the circumferential positioning of the first strand around the periphery of the member. Means for repositioning the first strand from the member into circumferential entanglement with the second strand proximate the passageway outlet is provided. The member can be adapted for reducing the circumference of the member at the outlet end of the passageway. The means for repositioning the first strand into entanglement with the second strand can be a means for supplying a fluid into contact with the first strand. The member can be hinged at its inlet end to permit the reducing of the circumference at the outlet end of the passageway. The member can be comprised of a pair of opposed concave surfaces.

Also, according to this invention there is provided a method of entangling a first strand and a moving second strand in which the second strand is passed through a passageway positioned within a member. The first strand is positioned circumferentially around the member. The first strand is then repositioned from the member into circumferential entanglement with the second strand proximate the passageway outlet. The circumference of the member can be reduced at the outlet end of the member passageway after the first strand is positioned circumferentially around the member. The repositioning of the first strand can be accomplished by supplying a fluid into contact with the first strand. The reducing of the circumference of the member can be effected by rotating a portion of the member about a hinge at the inlet end of the passageway.

This invention will be more fully understood by reference to the following drawings.

Figure 1:
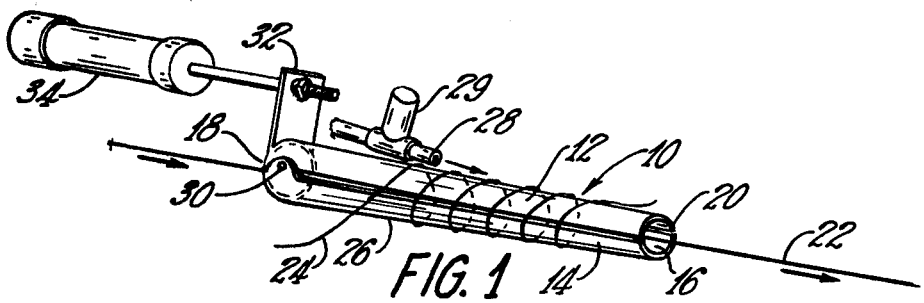
FIG. 1 is an isometric view of apparatus for the entanglement of a first strand and a moving second strand according to principles of this invention.
Figure 2:
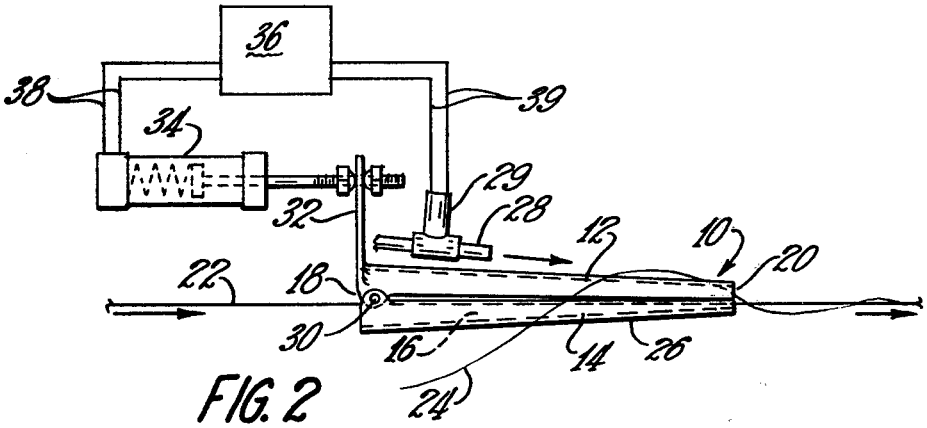
FIG. 2 is a side elevation view of the apparatus shown in FIG. 1, and including control apparatus.

Referring to FIGS. 1 and 2, there is shown member 10, which will hereinafter be referred to as the entanglement member, and which can be comprised of any number of segments, but preferably of top surface member 12 and bottom surface member 14, which, upon relative movement with respect to each other, allow reduction of the circumference of the outlet end of the member. The top surface member and the bottom surface member define passageway 16. The passageway has inlet end 18 and outlet end 20 for the passage of moving strand 22 therethrough. Auxiliary strand 24 can be wrapped or positioned circumferentially around the circumference 26 of the entanglement member. After the auxiliary strand is wrapped around the circumference of the entanglement member, and after the moving strand is passing through the passageway, the auxiliary strand can be brought into circumferential entanglement with the moving strand by the operation of nozzle 28, which can be operated by solenoid 29 to supply a fluid, such as air, from a source not shown, into contact with the auxiliary strand. The action of the fluid repositions the auxiliary strand from the circumference of the entanglement member into circumferential entanglement with the moving strand proximate the passageway outlet, and the auxiliary strand is thereby attached or added to the moving strand.

To facilitate the repositioning of the auxiliary strand, the entanglement member can be adapted so that its circumference at the outlet end of the passageway can be reduced. This will enable the auxiliary strand to be more easily repositioned from the periphery of the entanglement member. The reducing of the circumference can be accomplished by the pivoting of the top surface member about hinge 30. The top surface member can have lever arm 32 which can be connected to any suitable operating means such as hydraulic means 34. The operation of the hydraulic means rotates the top surface member about the hinge, thereby partially collapsing the entanglement member, to reduce the circumference of the entanglement member at the outlet end of the passageway. The operation of the hydraulic means can be controlled by control means 36 which is connected to the hydraulic means by leads 38. The control means can also be connected with the solenoid by leads 39 to control the solenoid and thus the fluid flow from the nozzle.

Figure 3:
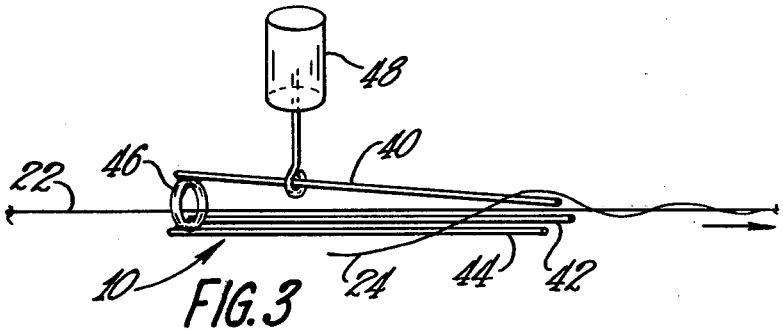
FIG. 3 illustrates another embodiment of the invention in which the member is comprised of three segments.

The entanglement member of this invention can be comprised of a plurality of segments forming a passageway for the passage of the moving strand. As shown in FIG. 3, the entanglement member is comprised of segments 40, 42, and 44 which are attached to entanglement member base 46. The auxiliary strand is wrapped around the circumference of the segments. One of the segments, such as segment 40, is hinged at inlet end of the passageway in order that the entanglement member be adapted to be partially collapsed in order to reduce its circumference at the outlet end of the passageway. The movement of the hinged segment can be accomplished by any suitable means such as hydraulic means 48. Alternatively, more than one of the segments can be hinged to permit the reduction of the circumference of the entanglement member.

Various modifications of the above described embodiments of the invention will be apparent to those skilled in the art, and it is to be understood that such modifications can be made without departing from the scope of the invention.

What is claimed is:

1. Apparatus for entanglement of a first strand and a moving second strand comprising:

(a) a member having a passageway therethrough, said passageway adapted for the passage of said second strand therethrough, said member being adapted for the circumferential positioning of said first strand thereon;

(b) repositioning means for moving said first strand from said periphery of said member into circumferential entanglement with said second strand proximate the passageway outlet; and, (c) means for reducing the circumference of said member at the outlet end of said passageway.

2. The apparatus of claim 1 in which said member is adapted to be partially collapsed to reduce the circumference of said member, and in which said means for reducing comprises means for partially collapsing said member.

3. The apparatus of claim 2 in which said repositioning means comprises means for supplying a fluid into contact with said first strand to move said first strand.

4. The apparatus of claim 3 in which said member is hinged at the inlet end of said passageway to permit the reducing of the circumference at the outlet end of said passageway.

5. The apparatus of claim 4 in which said member comprises a pair of opposed convex surfaces.

6. A method of entangling a first strand and a moving second strand comprising:

(a) passing said second strand through a passageway positioned within a member;

(b) positioning said first strand circumferentially around said member;

(c) changing the circumference of said member at the passageway outlet so that the circumference is reduced; and, (d) repositioning said first strand from said member into circumferential entanglement with said second strand proximate said passageway outlet.

7. The method of claim 6 in which reducing the circumference of the member at the outlet end of said passageway comprises partially collapsing said member.

8. The method of claim 7 in which said repositioning comprises supplying a fluid into contact with said first strand to move said first strand.

9. The method of claim 8 comprising rotating a portion of said member to reduce the circumference of the member at the outlet end of said passageway.

* * * * *